US006003820A

United States Patent [19]

Baldonado et al.

[11] Patent Number: 6,003,820

[45] Date of Patent: Dec. 21, 1999

[54] PLASTIC BAG HOLDER

[76] Inventors: Alonzo Baldonado; Rebecca Baldonado, both of 11012 Claremont N. E., Albuquerque, N.Mex. 87112

[21] Appl. No.: 09/097,115

[22] Filed: Jun. 12, 1998

[51] Int. Cl.[6] ..... B65B 67/04

[52] U.S. Cl. ..... 248/99; 248/95

[58] Field of Search ..... 248/95, 97, 98, 248/100, 101, 156, 149, 126; 383/33, 12; 294/55

[56] References Cited

U.S. PATENT DOCUMENTS

| | | | |
|---|---|---|---|
| 2,462,973 | 3/1949 | Kelrick | 248/101 |
| 3,936,087 | 2/1976 | Alexander | 294/1 R |
| 4,530,533 | 7/1985 | Dieter | 294/1.1 |
| 4,615,743 | 10/1986 | Bylenga | 134/6 |
| 4,664,348 | 5/1987 | Corsaut, III et al. | 248/99 |
| 4,759,519 | 7/1988 | Cheng | 248/99 |
| 4,775,123 | 10/1988 | Borland et al. | 248/99 |
| 4,805,858 | 2/1989 | Taylor | 248/99 |
| 4,832,291 | 5/1989 | Nelson et al. | 248/99 |
| 5,106,041 | 4/1992 | Jelincic | 248/99 |
| 5,222,536 | 6/1993 | Hodgdon et al. | 248/99 |
| 5,308,027 | 5/1994 | Fullilove | 248/99 |
| 5,377,941 | 1/1995 | Har et al. | 248/95 |
| 5,454,535 | 10/1995 | Thompson et al. | 248/99 |

*Primary Examiner*—Derek J. Berger
*Assistant Examiner*—Gwendolyn Baxter
*Attorney, Agent, or Firm*—Joseph N. Breaux

[57] ABSTRACT

A plastic bag holding assembly for holding a plastic bag in an open position so that a single user may be easily sweep debris into the open garbage bag the device includes a debris directing member with upright side walls forming a debris directing channel which provides a member for easily sweeping debris into the trash bag opening while the directing channel includes prevent debris from being swept around an outside portion of the opened plastic bag, the debris directing member also hold a flattened portioned of the opened bag in contact with a floor surface so that debris is not swept under the opened plastic bag. A "C" shaped resilient bag holding member is pivotally attached to the upright side walls and provides a maintaining member for the bag in an opened position and a holding member for the device to the opened bag.

3 Claims, 2 Drawing Sheets

PLASTIC BAG HOLDER

TECHNICAL FIELD

The present invention relates to devices and methods for plastic bag holders and more particularly to devices and methods for a plastic bag holder that has a "C" shaped section formed by two resilient rib members which secures a plastic bag in an opened position while the "C" shaped section is pivotally attached to side wall members of a debris directing channel member which resembles a dust pan. The device provides a combination plastic bag holder, a device which maintains a bag in an open position, a device which maintains a flattened portion of the bag in contact with a floor surface, and a device which directs debris into the opened plastic bag thereby allowing a single user to hold a plastic bag open and in position while also sweeping debris into the bag utilizing the attached debris directing member.

BACKGROUND ART

The increased use of plastic garbage bags has given rise to a problem associated with a single user attempting to fill the garbage bag with debris while at the same time holding the bag open. In a typical situation a user will attempt to hold a plastic garbage bag open, which is flimsy, while attempting to either sweep or place material into the opening. If the user is attempting to sweep debris into the opened garbage bag the user must also attempt to hold a flattened open edge of the garbage bag next to the floor surface so that as material is swept into the garbage bag, it is not swept under the garbage bag edge in contact with the floor. The inventor had found that he is able to solve the problem of holding a garbage bag open while a flattened portion of the garbage bag opening is held next to a floor surface, while also providing a dust pan type debris directing ramp which directs the debris into the garbage bag opening. There have been numerous devices developed which have attempted to overcome the problem associated with holding a garbage bag open while a user fills the garbage bag. Some of the prior art patents are as follows:

Taylor, U.S. Pat. No. 4,805,858 discloses a refuse bag holder which provides a means for holding a refuse bag in an open position. This device is useful for holding a bag in an open position however it does not provide a means for securing the opened refuse bag in contact with a floor surface so that as debris is swept into the opened bag the debris does not go under the device or the opened plastic bag. The present invention provides a debris directing tray which resembles a dust pan which has two raised side walls forming a directing channel and a pair of uprights rising from the side walls each pivotally connected to a resilience rib member having a left and right resilience rib member providing biasing forces which resiliently urge a garbage bag to remain in an opened position.

Borland, et al, U.S. Pat. No. 4,775,123 discloses a device for holding a thin flexible plastic bag with a flat edge for contacting a surface. This device is also useful for maintaining a bag in open position however it does not provide a means for directing debris into the opened bag as the present invention.

Corsaut, III, et al, U.S. Pat. No. 4,664,348 discloses a trash bag holder with a flexible plastic strip with intermediate straight portion adapted for insertion within the bag opening for alternative ground or floor engagement with the bag retained in an open receiving condition. This device is useful for holding a bag in an open position while also attempting to sweep debris into the open bag. The present invention differs from the Corsaut device in that the present invention includes two side walls forming a channel for directing debris which is swept into the opened trash bag. The directing channel and side walls provides a means for preventing the debris from being swept around the outside edge of the open bag. The present invention also includes a design which allows the device to be folded flat for easy storage, and also allows the angle of the opened plastic bag to be altered and held, in relation to the directing channel.

Bylenga, U.S. Pat. No. 4,615,743 discloses a bag holding apparatus to assist in the bagging of leaves or other lawn debris. This device is also useful for maintaining a bag in a open position however it does not provide a debris directing channel as the present invention.

Dieter, U.S. Pat. No. 4,530,533 discloses a support collar for trash bags. This device is also useful for holding a bag in an open position however it does not provide an easy to use bag insertable device which also includes a debris directing means for easily sweeping debris into the open bag.

As will be shown below the present invention differs from the prior art in that it provides not only a means for maintaining a plastic bag in a open position but also provides a directing debris channel way with raised channel side walls assuring that debris which is swept into the opened plastic bag will enter the open plastic bag rather than being swept around the outside opened edges of the plastic bag, and also provides a means for assuring that an edge of the plastic bag is held in contact with a floor surface so that debris is not swept under the plastic bag, and also provides foldable device which allows the device to be easily stored by allowing the resilient ribs to be folded down so that the device lays flat for storage. The present invention overcomes problems associated with the prior art in providing a means for maintaining the open plastic bag on a flat floor surface or other surface where debris will be swept into the opened bag quickly and easily.

GENERAL SUMMARY DISCUSSION OF INVENTION

It is thus an object of the invention to provide a Plastic Bag Holder that provides a means for maintaining a plastic bag in a open position while also holding a flattened portion of the bag next to a floor surface, and providing a means for directing debris to be swept into the opened bag and preventing the debris from being swept around an outside portion of the positioned bag, and a means for easily storing the device wherein the device is folded flat.

It is a further object of the invention to provide a Plastic Bag Holder that comprises an assembly for holding a plastic bag such as a garbage bag in an open position with a flat portion of the open bag held in contact with a floor or ground surface for receiving trash, leaves, and other debris. The plastic bag holding assembly includes a directing tray, which hold the flattened portion of the bag in contact with floor and provides a means for sweeping debris into the opened bag, the directing tray further comprises two upright side walls extending from the directing tray sides forming a directing channel, further wherein a "C" shaped member is pivotally attached to the upright side walls so that the C shaped member provides two upright resilient rib members pivotally connected to each side wall and permanently connected to one and other by a cross member, the resilient rib members are biased to expand outwardly so that when a plastic bag opening is placed around the two resilient rib members the members are biased to urge the plastic bag to remain in an open position and further hold the bag to the device, further the C shaped member is pivotally connected to the upright side walls in a manner such that the rib members maintain their position as a result of frictional forces between the rib member and the upright side walls allowing the user to maintain the plastic bag opening in a opened position and alternatively in a downwardly rotated position or flat for easily storing the device.

Accordingly, a Plastic Bag Holder is provided which includes a plastic bag holding assembly resembling a "C" shaped section having a flat bottom and opened end of the "C" which points upwardly forming two resilient rib members attached to a middle ross member of the "C" shaped member, while the C shaped member is pivotally attached to two upright side walls which in turn extend from a directing tray, wherein the directing tray forms debris directing member which ramps over a flat portion of the open plastic bag against a floor or ground surface providing a entry pathway for debris into the opened plastic bag while the side members extend from the outside edges of the debris directing member providing a channel directing means for the debris which is swept into the plastic bag, further wherein the "C" shaped resilience rib members are held into position by frictional pivotal attachment on the upright side wall members.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use a user would insert the plastic bag holder into a plastic trash bag by slightly compressing the resilient ribs of the "C" shaped section together. When released the resilient ribs of the "C" shaped section are biased to expand the opening of a plastic bag and further biased to hold the plastic bag to the device. When opened, the debris directing member would be pivoted to be oriented at about 90° to C shaped member. In this orientation, when the debris directing member is laid flat on a floor surface over a flattened portion of the opened bag, the plastic bag opening would be at about a 90° angle to the floor surface, thereby providing the user a flat surface for sweeping or raking debris directly into the opened bag. The debris directing member enables a single user to maintain a bag in a open position while directing debris into the open bag without bending or holding the bag in contact with the floor or ground surface. The debris directing member further includes two upright side walls which extend from a front to a rear of the debris directing member. The side walls provides a means for pivotally connecting the C shaped member to the debris directing member and further form a debris channel thereby forcing the debris to be maintained on the debris directing member and not flow around or off the debris directing member. When the bag is substantially filled the bag is simply slipped off the plastic bag holder for disposal. Furthermore, the debris directing assembly would then be rotated back 90° and allowing the device to be folded to a flat orientation for convenient storage. The use of the plastic bag holder provides a inexpensive and practical method for allowing one person to easily fill large plastic bags without the help of a second person.

Figure 1:
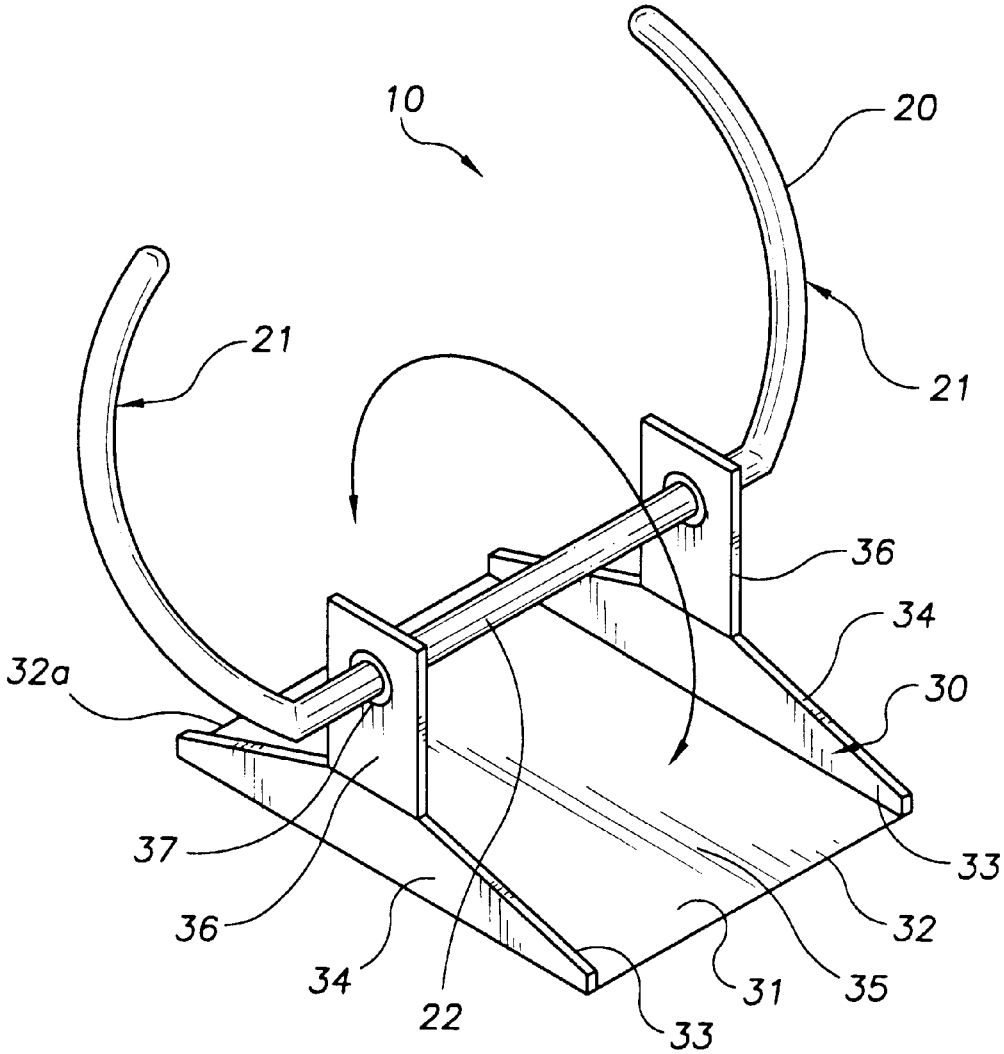
FIG. 1 is an isometric view of the plastic bag holding device illustrating the directional movement of the "C" shaped member in relation to the debris directing tray.
Figure 2:
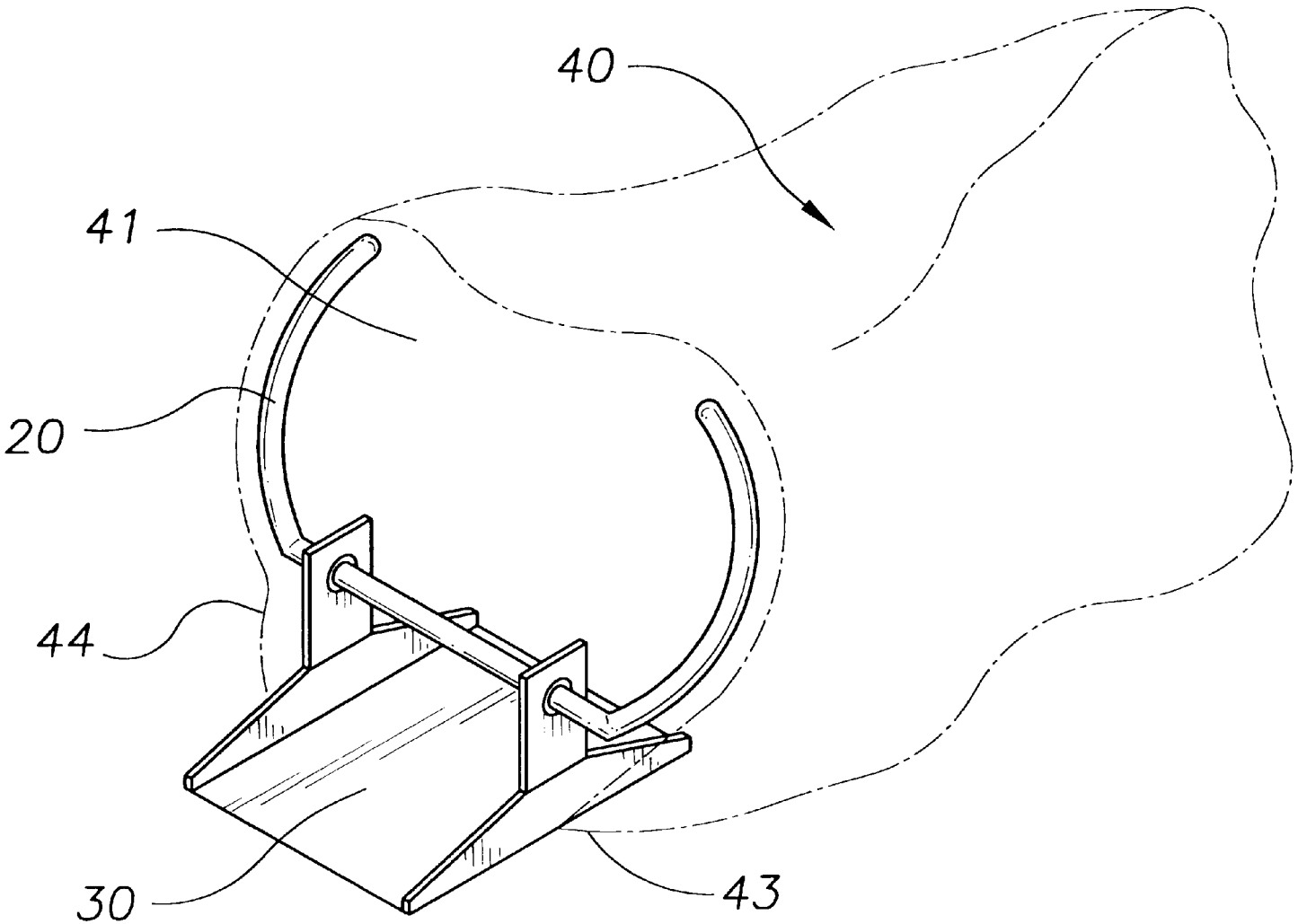
FIG. 2 is an isometric view of the plastic bag holding device with a plastic bag fitted into position for use.

Referring to the figures in detail FIG. 1 illustrates the plastic bag holder 10 with a "C" shaped section 20 and a debris directing member 30.

The "C" shaped section 20 includes a left and right resilient rib members 21 connected by cross member 22. The resilient rib members 21 biased to spread apart so that they must be compressed or squeezed together in order to be inserted into an opening 41 of a plastic bag 40. The "C" shaped member 20 including the resilient rib members 21 and the cross member 22 are constructed of a single piece of material and preferably constructed of a durable plastic material which maintains its configuration upon distortions and upon insertion and removal from a plastic bag desired to be maintained in open position. The device is contemplated to operate on numerous sized plastic bags and may be constructed to fit smaller kitchen plastic bags and also designed to fit larger size plastic bags and including the ubiquitous sizes on the market.

The debris directing member 30 includes a base member 31 which is substantially flat and rectangular in dimension and includes a front edge 32, two side edges 33, and back edge 32*a*. The base member 31 is preferably planar so that it contacts a ground or floor surface in a flat manner furthermore the base member 31 is laid inside of the opening of a plastic bag 41 and presses a flattened portion of a plastic bag opening 43 under the base member 31 and a floor surface thereby maintaining the flattened bag portion 43 in contact with the ground or floor surface so that as debris is swept into the opened plastic bag 41 the debris is not inadvertently swept under the plastic bag. The base member is preferably constructed of plastic, high density polymer, ABS plastic or some other durable suitable material.

Two side walls 34 extend from side edges 33 of the base member 31. The side walls 34 and the base member 31 form a directing channel 35. The side wall members 34 are preferable about two to about three inches tall, this height helps keep debris in debris channel and prevents debris from inadvertently swept off the debris directing member to an outside of the plastic bag. The directing channel 35 extends from a front edge 32 of the base member to a back edge 32*a* of the base member and provides a means for easily debris into a bag opening 41 while also maintaining the debris within the directing channel 35 way so that the debris is not swept around and outside portion of the open bag 44, the side walls 34 also provide a pivotal mounting means for the C shaped member to the debris directing member. Mounting tabs 36 extend from the side wall members 34 and include an aperture 37. Cross member 22 is snugly fitted into aperture 37 and provides a means for pivotally mounting the "C" shaped member to the debris directing member 30. As indicated by the double headed arrow in FIG. 1 the "C" shaped member may be pivoted 180° in relation to the directing channel member 30. In normal use the "C" shaped member resilient rib members 21 will extend perpendicular to an upper surface of the base member 31. The pivoting means also allows a user to pivot the bag while secured by the "C" shaped member in any orientation desired. The pivotal mount also allows the user to pivot the C shaped member to be flat for easily store the device.

The pivotal attachment of the "C" shaped member to the debris directing pan 30 also includes a means for selectively locking the "C" shaped member in an upright position as illustrated in FIG. 1. The pivotal attachment accordingly includes a frictional rotational attachment between the cross member 21 and aperture 37. herefor a rotational force is required for a user to urge the change in position of the "C" shaped member to a desired orientation so that the "C" shaped member does not inadvertently change position while in use.

It is noted that the embodiment of the Plastic Bag Holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Plastic Bag Holder device adaptable for use in maintaining a plastic bag opening in an open position, maintaining a flattened portion of a plastic bag opening in contact with a floor or ground surface thereby allowing a single user to sweep debris into the opening of the plastic bag and not sweeping the debris under the flattened portion of the plastic bag opening or around an outside portion of the opened plastic bag, the device comprising:

a) a debris directing member comprising a planar and rectangular base member with a front edge, back edge, two side edges, and top and bottom surfaces, upright side walls extending from each side edge and further extending from the front edge to the back along each side edge of the base member creating a debris channel defined by the space between the two side edges and the top surface of the base member, the bottom surface of the base member providing a planar surface for holding a flattened portion of a plastic bag opening in contact with a floor or ground surface, b) a C shaped member comprising two resilient rib members connected to each other by a cross member, the C shaped member is further pivotally attached to two mounting tabs, one mounting tab extending from each upright side wall and positioned on the upright side wall about mid way between the front and back edges of the base member, the resilient rib members are further biased to resist movement towards one another so that when a plastic bag opening is placed over the resilient ribs after a user has urged the resilient rib members towards one another and the resilient rib members are released the resilient rib members provide a means for maintaining the plastic bag on the C shaped member, the C shaped member further comprising a frictional pivotal attachment thereby preventing inadvertent pivoting of the C shaped member.

2. The Plastic Bag Holder of claim 1, wherein the upright side wall members further comprise side wall members extending from the side edges about two to about three inches thereby preventing debris, which is swept into the debris channel from being inadvertently sweep off of the debris directing member and not into the plastic bag opening.

3. The Plastic Bag Holder of claim 1, wherein the C shaped member further comprises a pivotally mounted C shaped member which is frictionally locked in a desired position and moved to a different desired location by urging the C shaped member with sufficient force to overcome the frictional resistance of the pivotal attachment thereby providing a means of assuring the positioning of the C shaped member in relation to the debris directing member.

* * * * *